US005547810A

United States Patent [19]

Morimoto et al.

[11] Patent Number: 5,547,810

[45] Date of Patent: Aug. 20, 1996

[54] IMAGE FORMING METHOD WITH ALKALI PRECURSOR

[75] Inventors: Hitoshi Morimoto; Kazuhiro Miyazawa; Masaru Tsuchiya, all of Hino, Japan

[73] Assignee: Konica Corporation, Tokyo, Japan

[21] Appl. No.: 520,600

[22] Filed: Aug. 29, 1995

[30] Foreign Application Priority Data

Sep. 16, 1994 [JP] Japan ..... 6-221887

[51] Int. Cl.[6] ..... G03C 1/43; G03C 8/40

[52] U.S. Cl. ..... 430/203; 430/617; 430/955; 423/641; 423/181

[58] Field of Search ..... 430/203, 617, 430/955

[56] References Cited

U.S. PATENT DOCUMENTS

| | | | |
|---|---|---|---|
| 2,592,250 | 4/1952 | Davey et al. | 95/7 |
| 3,134,764 | 5/1964 | Blout et al. | 260/162 |
| 3,220,613 | 11/1965 | Palmer et al. | 222/174 |
| 3,220,846 | 11/1965 | Tinker et al. | 430/955 |
| 3,227,550 | 1/1966 | Whitmore et al. | 96/3 |
| 3,249,393 | 5/1966 | Haas et al. | 8/4 |
| 3,260,598 | 7/1966 | Yutzy et al. | 430/206 |
| 3,271,257 | 9/1966 | Averette, Jr. | 167/84.5 |
| 3,317,322 | 5/1967 | Porter et al. | 96/108 |
| 3,330,633 | 7/1967 | Joseph et al. | 29/194 |
| 3,342,599 | 9/1967 | Reeves | 96/66.2 |
| 3,347,675 | 10/1967 | Henn et al. | 96/61 |
| 3,351,286 | 11/1967 | Abshire | 239/29.3 |
| 3,438,776 | 4/1969 | Yudelson | 96/28 |
| 3,447,927 | 6/1969 | Bacon et al. | 96/87 |
| 3,482,972 | 12/1969 | Idelson | 96/29 |
| 3,511,622 | 5/1970 | Nation | 29/193 |
| 3,523,795 | 8/1970 | Ohkubo et al. | 96/66 |
| 3,531,286 | 9/1970 | Renfrew | 96/67 |
| 3,531,291 | 9/1970 | Bacon | 96/108 |
| 3,544,546 | 12/1970 | Crabtree et al. | 260/145 |
| 3,597,200 | 8/1971 | Idelson | 96/29 |
| 3,645,739 | 2/1972 | Ohkubo et al. | 96/67 |
| 3,666,477 | 5/1972 | Goffe | 96/114.1 |
| 3,667,959 | 6/1972 | Bojara | 96/114.1 |
| 3,700,457 | 10/1972 | Youngquist | 96/114.1 |
| 3,703,584 | 11/1972 | Motter | 96/108 |
| 3,719,489 | 3/1973 | Cieciuch et al. | 96/29 |
| 3,719,492 | 3/1973 | Barr et al. | 96/55 |
| 3,736,140 | 5/1973 | Collier et al. | 96/64 |
| 3,761,266 | 9/1973 | Milton | 96/64 |
| 3,761,270 | 9/1973 | de Mauriac et al. | 96/77 |
| 3,761,276 | 9/1973 | Evans | 96/108 |
| 3,764,328 | 10/1973 | Birkeland | 96/67 |
| 3,794,496 | 2/1974 | Manhardt | 96/114.1 |
| 4,105,451 | 8/1978 | Smith et al. | 96/66 |
| 4,115,124 | 9/1978 | Hamilton et al. | 96/82 |
| 4,123,274 | 10/1978 | Knight et al. | 96/66 |
| 4,137,079 | 1/1979 | Houle | 96/55 |
| 4,138,265 | 2/1979 | Shiao | 96/114.1 |
| 4,362,806 | 12/1982 | Whitmore | 430/202 |
| 4,375,507 | 3/1983 | Whitmore | 430/236 |
| 4,500,627 | 2/1985 | Naito et al. | 430/203 |
| 4,740,363 | 4/1988 | Hirai et al. | 430/203 |
| 4,740,445 | 4/1988 | Hirai et al. | 430/203 |
| 4,876,171 | 10/1989 | Hirai | 430/203 |
| 4,880,723 | 11/1989 | Hirai et al. | 430/203 |

*Primary Examiner*—Richard L. Schilling
*Attorney, Agent, or Firm*—Finnegan, Henderson, Farabow, Garrett & Dunner, L.L.P.

[57] ABSTRACT

An image forming method comprises the steps of (a) exposing a silver halide photographic light-sensitive material comprising a first support and provided thereon, a photographic component layer comprising a first binder, light sensitive silver halide and a sparingly water soluble metal compound; (b) superposing the exposed material on an image receiving material comprising a second support and provided thereon, an image receiving layer comprising a second binder and a compound represented by Formula (I),

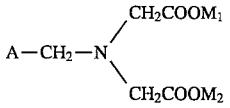

Formula (I)

wherein A represents a cycloalkyl group, an aryl group or a heterocyclic ring; and $M_1$ and $M_2$ independently represent an alkali metal atom, an ammonium ion or a quaternary ammonium ion; (c) heating the superposed materials in the presence of water; and (d) separating the image receiving material from the exposed material to obtain an image on the image receiving layer of the image receiving material.

8 Claims, No Drawings

IMAGE FORMING METHOD WITH ALKALI PRECURSOR

FIELD OF THE INVENTION

The present invention relates to an image forming method of employing an alkali produced during complex forming reaction, and particularly to an image forming method giving a high contrast image with little image unevenness and excellent gloss on an image plane.

BACKGROUND OF THE INVENTION

In conventional photographic image forming processes, photographic solutions such as developer, fixer and bleach-fixer are usually employed. In order to remove complications using these solutions, a silver salt diffusion transfer method, a wet color diffusion transfer method (so-called instant color photography) and a heat development method are put into practical use.

In the heat development method, in which development is carried out by applying heat, a method giving a white and black image or a color image is known, and an image transfer type heat developable light sensitive material, in which a developed image is transferred to an image receiving layer, is also well known.

The heat developable light sensitive material usually comprises a support, a binder, a light sensitive silver halide emulsion, a reducing agent, optionally a dye providing material, an organic silver salt or other photographic additives. In the image transfer type heat developable light sensitive material, a light sensitive material and an image receiving layer receiving silver or a dye are formed as one body or separately.

In order to obtain a high contrast image in a method employing such a heat developable light sensitive material, a method was examined in which pH is elevated in a development and/or image transfer process. For example, Japanese Patent O.P.I. Publication Nos. 56-130745/1981 and 56-132332/1981 disclose a method in which at least one of a heat developable light sensitive material and an image receiving layer contains an alkali providing material. However, this method tends to elevate pH in a coating solution containing an alkali component, and affects physical properties of a hydrophilic binder, resulting in coating faults. Further, the image formed is likely to have uneven density in which image density is extraordinarily lower (so-called white spots) or higher (so-called black spots) than the neighboring image density. The alkali containing coating solution, when neutralized with an acidic component to maintain the physical properties of the hydrophilic binder, does not sufficiently show desired pH increasing effects.

British Patent No. 998949, U.S. Pat. Nos. 3,220,846 and 3,523,795, Japanese Patent O.P.I. Publication Nos. 50-22625/1975, 59-168440/1984, 59-168441/1984, 59-180537/1984, 60-237443/1985, 61-32844/1986, 61-36743/1986, 61-52639/1986, 61-51139/1986, 61-51140/1986, 61-52638/1986, 61-53631/1986, 61-53634/1986, 61-53635/1986, 61-53636/1986, 61-53637/1986, 61-53638/1986, 61-53639/1986, 61-53640/1986, 61-55644/1986, 61-55645/1986, 61-55646/1986, 61-219950/1986 and 61- 251840/1986 disclose a method in which a heat developable light sensitive material and/or an image receiving layer contains an alkali providing material (an alkali precursor) releasing or forming an alkali component on application of heat. In this method, however, the heat developable light sensitive material or image receiving layer containing an alkali precursor is likely to be affected by atmospheric conditions. As a result, there are problems such that the materials tend to have a sticky surface, the image formed has image unevenness, and the precursor decomposes, resulting in deterioration of photographic properties.

U.S. Pat. No. 3,260,598 discloses an image forming method employing a process in which pH increases on reaction during development of a sparingly water-soluble metal hydroxide with a sodium or potassium salt (hereinafter referred to also as a complex forming compound) of a ligand which is capable of coordinating with the metal contained in the sparingly water-soluble metal hydroxide. This method can prevent deterioration of physical layer properties or photographic properties during storage, since the sparingly water-soluble metal hydroxide and complex forming compound are present separately before the image forming reaction. However, this method, when applied to heat development, does not give a satisfactory contrast image.

Japanese Patent O.P.I. Publication No. 62-187847/1987 discloses a method which produces an alkali during the complex forming reaction of a heterocyclic carboxylic acid salt having a specific structure, represented by picolinic acid guanidine salt, with a sparingly water-soluble metal compound such as zinc hydroxide. However, when the specific heterocyclic carboxylic acid salt, represented by picolinic acid guanidine salt, is added to a layer containing a hydrophilic binder, the layer tends to have a sticky surface under high humidity, and there is also a problem in view of physical layer properties.

Japanese Patent O.P.I. Publication No. 62-174745/1987 discloses a method which produces an alkali on reaction of a sparingly water-soluble metal compound with a neutral water soluble compound which is capable of forming a still less water-soluble metal compound on reaction with a metal ion contained in the sparingly water-soluble metal compound. In this method, a sparingly water-soluble salt such as silver carbonate or calcium hydroxide and a water-soluble salt such as a water soluble fluoride or iodide are employed which has a great influence on photographic properties. Since barium carbonate has a great tendency to form a sparingly water-soluble salt on reaction with a sulfonic acid, there is a problem that the carbonate can not be used in combination with pH adjusting agents such as surfuric acid or photographic agents having a sulfonate group.

The present inventors have proposed in Japanese Patent Application No. 5-316902/1993 that a method employing an aminopolycarboxylic acid derivative whereby improved physical layer properties and a high contrast image can be obtained. In this method, however, gloss of the image plane and peelability after development of a light sensitive material from an image receiving layer are not always satisfactory, and further improvement has been desired.

SUMMARY OF THE INVENTION

The present invention has been made in view of the above.

An object of the invention is to provide an image forming method employing an alkali released during complex forming reaction and giving a high contrast image. Another object of the invention is to provide an image forming method which is excellent in physical layer properties, gloss of the image plane and peelability after development of a light sensitive material from an image receiving layer.

DETAILED DESCRIPTION OF THE INVENTION

The above object of the invention can be attained by the following methods:

(1) an image forming method employing water, a sparingly water soluble metal compound, a compound represented by the following Formula (I):

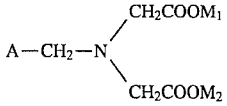

Formula (I)

wherein A represents a cycloalkyl group, an aryl group, a heterocyclic ring, each of which may have a substituent; and $M_1$ and $M_2$ independently represent an alkali metal atom, an ammonium ion or a quaternary ammonium ion and may be the same as or different from each other, (2) an image forming method comprising the step of exposing a silver halide photographic light-sensitive material comprising a first support and provided thereon, a first binder, light sensitive silver halide grains and a sparingly water-soluble metal compound, and superposing in the presence of water the exposed material on an element comprising a second support and provided thereon, a second binder and the compound represented by Formula (I) above, (3) an image forming method of (2) above, wherein the silver halide photographic light-sensitive material contains a non-diffusible dye providing material capable of releasing or forming a diffusible dye on image forming and the element is a dye receiving material containing a dye mordant, (4) an image forming method of (1), (2) or (3) above, wherein development is carried out at 60° C. or more, (5) an image forming method of (2) above, wherein the surface of the element has pH of 8.5 to 10.5, the surface is being directly contacts the silver halide photographic light-sensitive material.

In the image forming method of the invention, an alkali contributes to the image forming process of the invention wherein the alkali is produced in the presence of water during reaction of a sparingly water-soluble metal compound with a compound represented by Formula (I) which is capable of forming a complex in the presence of water and a metal ion contained in the sparingly water-soluble metal compound.

The invention will be described in detail below.

In Formula (I), A represents a cycloalkyl group, an aryl group such as a phenyl group or a naphthyl group or a heterocyclic group, each of which may have a substituent; and $M_1$ and $M_2$ independently represent an alkali metal atom, an ammonium ion or a quaternary ammonium ion and may be the same as or different from each other. The aryl or heterocyclic group includes a condensed ring. The cycloalkyl or heterocyclic group is not specifically limited to the form of the ring, but is preferably a 5- or 6-membered ring. Of the compounds represented by Formula (I), the compounds in which A is a pyridyl, pyradinyl, pyrimidinyl, pyridadinyl, pyrrolyl, pyrazolyl, imidazolyl, tetrazolyl, furyl or phenyl group, each of which may have a substituent, are preferable.

The substituent referred to herein includes an aliphatic group, an aryl group, a heterocyclic group, a halogen atom or a cyano, nitro, hydroxy, carboxyl, carbonyl, oxycarbonyl, carbamoyl, alkoxy, aryloxy, heterocyclicoxy, carbonyloxy, sulfonyloxy, amino, sulfonylamino, sulfamoylamino, acylamino, ureido, sulfonyl, sulfamoyl, alkylthio, arylthio or heterocyclicthio group. The aliphatic group includes a straight-chained or branched alkyl or alkenyl group or a halogenated alkyl group. The aryl group includes phenyl, 1-naphthyl or 9-anthranyl. The heterocyclic group includes 2-tetrahydrofuryl, 2-thiophenyl, 4-imidazolyl or 2-pyridyl. a straight-chained of branched alkyl or alkenyl group.

The typical examples of the compounds represented by Formula (I) will be shown below, but the invention is not limited thereto.

A-1

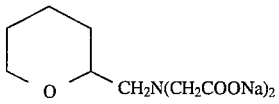

A-2

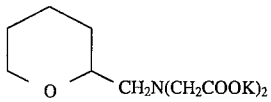

A-3

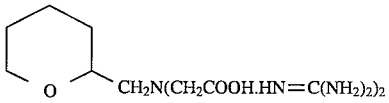

A-4

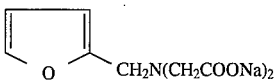

A-5

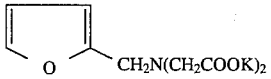

A-6

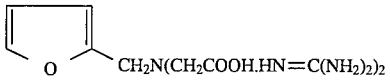

A-7

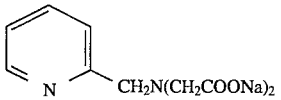

A-8

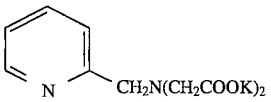

A-9

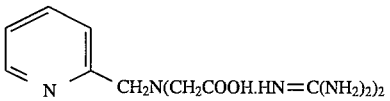

A-10

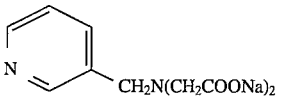

A-11

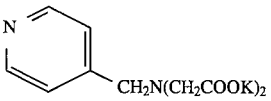

A-12

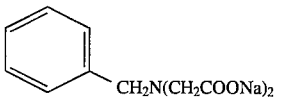

A-13

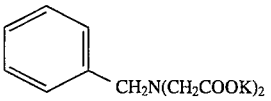

A-14

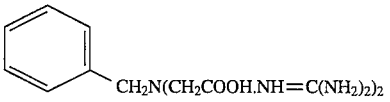

-continued

A-15

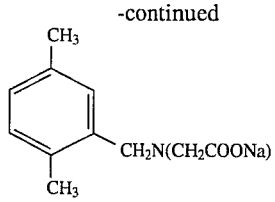

A-16

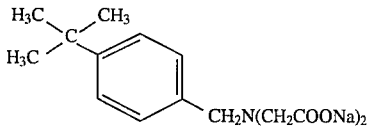

A-17

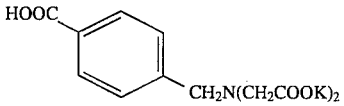

A-18

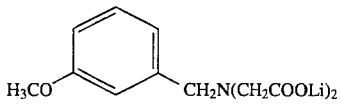

A-19

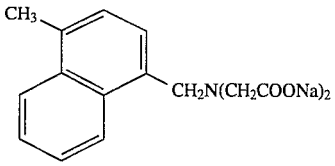

A-20

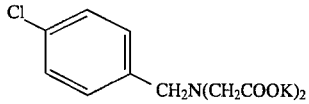

These complex forming compounds are available on the market. Further, many synthetic method of the compounds are described in Beilsteins Handbuch der Organischen Chemie, Ann. Chem., Chemical Abstracts, J. Am. Chem. Soc., Monatasch. Chem. or Journal der Russischen Physikalisch-Chemichen Gesellshaft, and the compounds can be synthesized according to the methods described in these literatures.

The sparingly water-soluble metal compounds (hereinafter referred to as also sparingly soluble metal compounds) includes oxides, hydroxides, carbonates, phosphates, silicates, borates and aluminates which have a solubility in 20° C. water of 0.5 or less. Of these compounds, the metal compound represented by the following Formula (II) is especially preferable.

$$Z_mX_n \qquad \text{Formula (II)}$$

wherein Z represents a metal atom other than an alkali metal atom; X represents an oxygen, hydroxide, carbonate, phosphate, silicate, borate or aluminate ion; and m and n independently represent an integer necessary to neutralize the charge of the compound.

The metal compound represented by Formula (II) may have crystal water or form a complex salt.

The preferable example of Z includes a transition metal ion such as $Zn^{2+}$, $Co^{2+}$, $Ni^{2+}$, $Fe^{2+}$, $Mn^{2+}$, $Cu^{2+}$, $Hg^{2+}$ or $Zr^{2+}$, and an alkali earth metal ion such as $Ba^{2+}$, $Sr^{2+}$ or $Ca^{2+}$, and the especially preferable is $Zn^{2+}$.

The preferable example of X includes an oxygen, hydroxide, phosphate and carbonate ion.

The typical example of the compound includes $Zn(OH)_2$, ZnO, $Co(OH)_2$, CoO, $Ni(OH)_2$, $Cu(OH)_2$, $Fe(OH)_2$, $Mn(OH)_2$, $BaCO_3$, $SrCO_3$, $CaCO_3$, basic lead carbonate, basic cobalt carbonate, basic nickel carbonate and basic bismuth carbonate. Of these compounds, compounds having no coloration in the dispersion containing water are preferable, and $Zn(OH)_2$ is especially preferable.

A combination of the compound represented by Formula (I) with the sparingly water soluble metal compound is arbitrary, and the compounds may be used singly or in combination, respectively. The amount used of the compounds are different depending upon the conditions used or the necessary alkali amount, but the ratio of the compound represented by Formula (I) to the sparingly water soluble metal compound is 10:1 through 1:10, and preferably 5:1 through 1:5.

The image forming method of the invention includes the conventional various methods, but preferably a method in which none of developer, fixer and bleach-fixer are used, for example, a silver halide diffusion transfer method, a wet color diffusion transfer method (so-called instant color photography) or a heat development method.

The heat development method using water will be detailed below, which is prefarable in the image forming method used in the invention.

The compound represented by Formula (I) and the sparingly water-soluble metal compound can be externally supplied in the form of solution or dispersion before or during the image forming step, but they are preferably contained in one of a light sensitive material and an image receiving material.

The compound represented by Formula (I) may be added to a light sensitive material or an image receiving material in the form of solution or dispersion, but is preferably a compound having no color in a coating solution or a layer after its coating. The compound is preferably contained in one of a light insensitive layer of a light sensitive material and an image receiving material, especially in the image receiving material since deterioration during storage of photographic properties can be prevented. The content of the compound is preferably 1 to 100 millimol/$m^2$, and more preferably 5 to 50 millimol/$m^2$ based on the total image forming material.

In order to prevent a complex forming reaction in a coating solution, the sparingly soluble metal compound is preferably contained in a layer different from that containing a compound represented by Formula (I). It is more preferable that the sparingly soluble metal compound is contained in a light insensitive layer of a light sensitive material and the compound represented by Formula (I) is contained in an image receiving layer. The content of the sparingly soluble metal compound is preferably 1 to 200 millimol/$m^2$, and more preferably 5 to 100 millimol/$m^2$ based on the total image forming material in view of the effects of the invention, although it depends its particle size.

When the compound represented by Formula (I) and the sparingly soluble metal compound are incorporated to a light sensitive material or an image receiving material, they are generally dispersed in a binder described later, which is preferably hydrophilic.

The pH of a surface (hereinafter referred to as also layer surface pH) on the side of a layer containing the compound represented by Formula (I) is preferably 8.5 to 10.5 in view of the effects of the invention. The term "layer surface pH" is a value obtained by measuring using a surface pH electrode at 20° to 25° C. after 0.03 ml of ion-exchange water (pure water) is dropped on a layer to be measured.

When the image forming method is applied to a color light sensitive material, a dye providing material is used as a component of the color light sensitive material. The dye providing material is preferably a non-diffusible dye providing material forming or releasing a diffusible dye on development. Such a dye providing material includes a well known dye providing material which is used in a wet diffusion transfer method or a heat development diffusion transfer method.

The material releasing a diffusible dye on heat development includes a dye providing material which is oxidized on development to release a dye or a dye precursor, as disclosed in Japanese Patent Publication Nos. 48- 33826/1973, 53-50736/1978, 51-113624/1986, 56-12642/1981, 57- 650/1982, 51-104343/1976, 53-46730/1978, 54-130112/1979, 57- 85055/1982, 59-165054/1984, 61-193149/1986 and 62-228443/1987.

Another dye providing material includes one which itself is hydrolyzed in the presence of an alkali to release a diffusible dye but does not release a diffusible dye on reaction with an oxidation product of a developing agent, as disclosed in Japanese Patent Publication Nos. 51-63618/1976, 53-69033/1978, 54-130927/1979, 49-111626/1974, 52-4819/1977, 59-124327/1984 and 59-152440/1984.

Still another dye providing material includes one which itself does not release a dye but releases a diffusible dye on reaction with a reducing agent which remains without being employed for development, as disclosed in Japanese Patent Publication Nos. 53-35533/1978, 53-110827/1978, 54-30927/1979, 56-164342/1981 and 62-215270/1987, U.S. Pat. No. 4,358,525, Japanese Patent O.P.I. Publication No. 1- 20553/1989, and Japanese Patent Publication Nos. 3-65535/1991 and 4-11017/1992.

Still further another dye providing material includes one which releases a diffusible dye in the presence of a silver ion or soluble silver ion complex constituting silver halide or an organic silver salt which remains without being developed, as disclosed in Japanese Patent Publication No. 59- 180548/1984 and U.S. Pat. Nos. 4,362,806, 3,719,489 and 4,375,507.

The coupler can be used in the invention in which a diffusible image forming dye is bonded to a releasing group in an active site, as disclosed in Japanese Patent Publication No. 48-39165/1973, U.S. Pat. No. 3,227,550, and Japanese Patent O.P.I. Publication Nos. 57-186744//1982, 58-79247/1983 and 59- 176744/1984.

The dye providing material can be used which has reducing property to silver halide and is diffusible under an alkaline condition but is oxidized corresponding to development of silver halide to lower its diffusibility, as disclosed in U.S. Pat. Nos. 3,134,764, 3,597,200, 3,544,546 and 3,482,9723,531,286 and Japanese Patent O.P.I. Publication Nos. 59-165054//1983, 61-193149/1986 and 61-228443/1986.

The dye providing material used in a process in which a diffusible image forming dye is formed on heat development includes a dye providing material capable of forming a diffusible dye on coupling reaction with an oxidation product of a developing agent produced in reduction of silver halide and/or an organic silver salt. This dye providing material is disclosed in, for example, U.S. Pat, No. 3,531,286, Japanese Patent Publication Nos. 3-60419/1991, 1-46054/1989, 1- 40973/1989, 1-35334/1989 and 3-74818/1991, Japanese Patent O.P.I. Publication Nos. 62-123456/1987, 63-118155/1988 and 63- 144350/1988.

The dye providing material of the present invention may be used alone, or in combination of two or more kinds of them. The amount used may be varied due to the kind of the dye providing material or the application method of a heat processable light sensitive material. Generally, the amount is 0.05 to 10 g, and preferably 0.1 to 5 g per $m^2$ of the light sensitive material.

As a method for incorporating a dye providing material in a photographic constituting layer of a heat processable light sensitive material, any conventional method such as a method wherein the dye providing material is emulsified and dispersed in a hydrophilic colloidal solution by the use of dibuthylphthalate, dioctylphthalate or tricresylphosphate, a method wherein a dye providing material is dissolved in an aqueous alkali hydrophilic colloidal solution and then neutralized with an acid for dispersion or a method wherein a dye providing material is dispersed mechanically for fine grains solid state in an aqueous hydrophilic colloidal solution for dispersing can be employed. When a dye providing material is used for a dispersion of fine grains, its average grain size is 0.05 to 10 μm and preferably 0.1 to 5 μm.

In addition, the image forming method of the present invention can be applied to a heat processable light sensitive material employing an image-forming method wherein a dye providing material is incorporated in a micro-capsule together with a polymerizable compound as described in Japanese Patent Publication Open to Public Inspection Nos. 2-293753/1990 and 2-308162/1990, the capsule is subjected to heat development so that polymerization reaction of the polymerizable compound is caused imagewise or reversely imagewise to harden the micro-capsule and diffusion property of the dye providing material to the image-receiving layer is varied.

A light sensitive silver halide used in the heat processable light sensitive material of the present invention includes conventional types such as silver chloride, silver bromide, silver bromoiodide, silver bromochloride and silver bromochloroiodide.

The above-mentioned silver halides may have a uniform composition throughout portions from inside of a grain to the surface thereof, a so-called core/shell structure wherein the composition of the inside is different from the surface thereof and a multilayered structure wherein the composition is varied stepwise or continuously.

In addition, the silver halide may be mono-dispersed wherein grain sizes are relatively uniform or poly-dispersed having wide grain distribution.

As a form of silver halide, those having specific crystal habit such as a cube, a sphere, an dodecahedron and a tetradecahedron and those having no specific crystal habit can be used. In addition, tabular silver halides as described in Japanese Patent O.P.I. Publication Nos. 58-111933/1983 and 58- 111934/1983 and Research Disclosure (RD) No. 22534 wherein a grain has a two-paralleled crystal surface, its crystal surface respectively has area larger than the crystal surface of other crystal surfaces and the ratio of the grain diameter to the grain thickness is about 5 or more.

In addition, inside-latent-image silver halide emulsions as described in U.S. Pat. Nos. 2,592,250, 3,220,613, 3,271,257, 3,317,322, 3,511,622, 3,531,291, 3,447,927, 3,761,266, 3,703,584, 3,736,140 and 3,761,276 and Japanese Patent O.P.I. Publication Nos. 50-8524/1975, 50-38525/1975, 52-15661/1977 and 55-127549/1980 wherein the surface of grains are not fogged in advance.

Ions of metals such as iridium, gold, rhodium, iron and lead can be added to light sensitive silver halide grains, in a form of salt at an arbitrary step during the formation of grains. In such cases, it is ordinary to add these metallic ions in a range from $10^{-7}$ to $10^{-5}$ mol per mol of silver.

The grain size of the above-mentioned light sensitive silver halide emulsion is about 0.05 to 2 μm. In addition, it is allowed to use, for adjusting gradation, silver halide having grains with different grain sizes each other in the same light sensitive layer can be used in combination.

The light sensitive silver halide may be also prepared by existing components for forming light sensitive silver halide components together with an organic silver salt described later and by converting a part of the organic silver salt to the light sensitive silver halide.

The silver halide emulsion in the invention can be subjected to the conventional chemical or optical sensitization. The sensitizing dye may be added at any step of the preparation of a silver halide emulsion, for example, during the formation of silver halide grains, when soluble salts are removed, before chemical sensitization or during or after chemical sensitization. The amount used of sensitizing dye is $10^{-5}$ to $10^{-2}$ mol per mol of silver halide.

The above-mentioned light sensitive silver halide or components for forming light sensitive silver salts are used in a range from about 0.01 to 10 g, preferably in a range from 0.05 to 1 g, per 1 $m^2$ of each light sensitive layer of the light sensitive material.

To the heat processable light sensitive material used in the method of the present invention, an organic silver salt can be used for enhancing sensitivity and improving developing property.

The organic silver salt includes a silver salt of a long-chained aliphatic carboxylic acid or a carboxylic acid having a heterocyclic ring (for example, silver behenate or silver α-(1-phenyltetrazolethio) acetate) described in Japanese Patent O.P.I. Publication Nos. 53-4921/1988, 49-52626/1974, 52-141222/1977, 53-36224/1988, 53-37626/1988, 53-36224/1988 and 53-37610/1988 and U.S. Pat. Nos. 3,330,633, 3,794,496 and 4,105,451, a silver salt of a compound having an imino group described in Japanese Patent Publication Nos. 44-26582/1969, 45-12700/1970, 45-18416/1970 and 45-22815/1970 and Japanese Patent O.P.I. Publication Nos. 52-137321/1977, 58-118638/1983 and 58-118639/1983 and U.S. Pat. No. 4,123,274, and silver acetylide described in Japanese Patent O.P.I. Publication No. 61-249044/1986. Of these, the silver salt of the compound having an imino group are preferable. A silver salt of benzotriazole or its derivative are especially preferred. The amount used of the organic silver salt is in a range from 0.005 g to 10 g, preferably in a range from 0.01 g to 5 g per 1 $m^2$ of light sensitive material.

Th light sensitive material used in the image forming method of the present invention may contain a reducing agent which is selected according to a development mechanism, a dye-forming mechanism or a dye-releasing mechanism.

The reducing agent includes p-phenylenediamine developing agents and p-aminophenol developing agents, phosphoric acid aminophenol developing agents, sulfonamide aniline developing agents, hydrazone developing agents, phenols, sulfonamide phenols, polyhydroxybenzenes, naphtols, hydroxybis naphtyls, methylenebisphenols, ascorbic acids, 1-aryl-3-pyrazolidones and hydrazones and the precursors of the above-mentioned reducing agents as described in US Pat. Nos. 3,351,286, 3,761,270, 3,764,328, 3,342,599, and 3,719,492, Research Disclosure Nos. 12146, 15108 and 15127, Japanese Patent O.P.I. Publication Nos. 56-27132/1981, 53-135628/1978 and 57- 79035/1982. The dye providing material can be used as a reducing agent, too.

Two or more reducing agents can be used in combination. Especially, combination of 1-aryl-3-pyrazolidone and an anti-diffusible hydroquinone derivative is preferable. The amount used of the reducing agent is in a range from 0.01 to 100 millimol per 1 $m^2$ of light sensitive material.

A binder is used in the light sensitive material or image receiving material in the present invention. The binder includes synthetic or natural polymers such as ethyl cellulose, polyvinyl alcohol, polyvinyl pyrrolidone, gelatin, gelatin derivatives such as phthalated gelatin, cellulose derivatives, protein, starch, gum arabic, pullulan and dextran. They can be used independently or two or more of them can be used in combination. The synthetic polymers have an average molecular weight of preferably 2,000 to 1,000,000.

Of these polymers, gelatin is especially preferable. The gelatin includes ones subjected to ordinary alkali treatment or acid-treated gelatins or gelatin derivatives such as phenyl carbamoyl gelatin and phthalic gelatin. Two or more of them can be used in combination. A combination of the above-mentioned gelatin and a water-soluble polymer is especially, preferable, too. The amount used of the binder is ordinarily from 0.1 to 50 g, and preferably 1 to 20 g, per 1 $m^2$ of support.

It is preferable that the binder is hardened with the conventional photographic binder. As a hardener, a vinyl sulfon type hardener, an aldehyde type hardener, an epoxy type hardener, an N-methylol type hardener, a halogen-substituted-s-triazine type hardener and a polymer hardener are used.

In the light sensitive material or image receiving material of the present invention, various kinds of additives described below may be optionally used.

(Heat Solvent)

The heat solvent is liquidified in heat development so that it promotes heat development or heat transfer of dye. It is preferred that the heat solvent is in a solid state at room temperature.

The heat solvent includes compounds described in U.S. Pat. Nos. 3,347,675, 3,667,959, 3,438,776 and 3,666,477, RD 17,643 and Japanese Patent O.P.I. Publication Nos. 51-19525/1976, 53-24829/1978, 53-60223/1978, 58-118640/1983, 58- 198038/1983, 59-229556/1984, 59-68730/1984, 59-84236/1984, 60- 191251/1985, 60-232547/1985, 60-14241/1985, 61-52643/1986, 62- 78554/1987, 62-42153/1987, 62-44737/1987, 63-53548/1988, 63- 161446/1988, 1-224751/1989 and 2-863/1990.

Of the above-mentioned heat solvents, water-insoluble solid heat solvents are preferably used. The typical examples thereof are compounds described in Japanese Patent O.P.I. Publication Nos. 62-136645/1987, 62-139545/1987, 63-161446/1988, 1-224751/1989, 2-863/1990, 2-120739/1990 and 2- 123354/1990.

The heat solvent can be added in an arbitrary layer such as a light sensitive silver halide emulsion layer, an intermediate layer, a protective layer, an image-receiving layer for an image receiving material. The amount added is 5 to 500% by weight and preferably 10 to 200% by weight based on the binder content.

(Development Accelerator)

As a development accelerator, compounds described in Japanese Patent O.P.I. Publication Nos. 59-177550/1984, 59- 111636/1984, 59-124333/1984, 61-72233/1986, 61-236548/1986 and 1-152454/1989 are useful. In addition, compounds releasing a development accelerator described in 61-159642/1986, 1- 104645/1989 and 1-110767/1989 may also be used.

(Anti-Foggant)

Higher fatty acid described in U.S. Pat. No. 3,645,739, N-halogenated compounds described in Japanese Patent O.P.I. Publication No. 51-47419/1976, compounds releasing mercapto compounds described in U.S. Pat. No. 3,700,457 and Japanese Patent O.P.I. Publication Nos. 51-50725/1976, 2-29754/1990 and 2-282241/1990, aryl sulfonic acids described in Japanese Patent O.P.I. Publication No.

49-125016/1974, oxidizers described in British Patent No. 1,455,271 and Japanese Patent O.P.I. Publication No. 50-101019/1975, sulfonic acids and thiosulfonic acids described in Japanese Patent O.P.I. Publication No. 53-19825/1988, thiouracyls described in Japanese Patent O.P.I. Publication No. 51-3223/1976, sulfur described in Japanese Patent O.P.I. Publication No. 51- 26019/1976, disulfides and polysulfides described in Japanese Patent O.P.I. Publication Nos. 51-42529/1976, 51-81124/1976 and 55-93149/1980, rhodine or ditelpenes described in 57435/1976, polymer acids having a sulfonic acid group or a carboxylic acid described in Japanese Patent O.P.I. Publication No. 51-104338/1976, thiazolithione described in U.S. Pat. No. 4,138,265, triazoles described in Japanese Patent O.P.I. Publication Nos. 54-51821/1979 and 55- 142331/1980 and U.S. Pat. No. 4,137,079, thiosulfinic acid esters described in Japanese Patent O.P.I. Publication No. 55-140883/1980, di- or tri-halogenated materials described in Japanese Patent O.P.I. Publication Nos. 59-46641/1984, 59-57233/1984 and 59-57234/1984, thiol compounds described in Japanese Patent O.P.I. Publication No. 59-111636/1984 and hydroquinone derivatives described in Japanese Patent O.P.I. Publication Nos. 60-198540/1985 and 60-227255/1985, anti-foggants having a hydrophilic group described in Japanese Patent O.P.I. Publication No. 62-78554/1987, anti-foggant polymers described in Japanese Patent O.P.I. Publication No. 62-121452/1987 and anti-foggants having a ballast group described in Japanese Patent O.P.I. Publication No. 62- 123456/1987 are cited. In addition, water-soluble halogenated compounds can be also used for preventing fog.

The above-mentioned anti-foggants can be added to any layer of a heat processable light sensitive materials or a image receiving material.

(Silver Ion Scavenger)

The silver ion scavenger includes non-diffusible compounds capable of forming a stable complex with a physical development nuclei or silver ions described in Japanese Patent O.P.I. Publication No. 63-163345/1988, compounds forming a sparingly soluble salt and compounds described on page 6 of Japanese Patent Internatinal Publication No. 63-501745/1988.

(Solvent for Silver halide)

Compounds of the formulas described in Japanese Patent O.P.I. Publication No. 62-283335/1987, from the 15th line on the upper left column on page 3 to page 11.

To the light sensitive material of the present invention, various kinds of photographic additives other than those described as above, for example, filter dyes, colloidal silver, fluorescent brightening agents, antistatic agents, surfactants, matting agents, anti-fading agents, UV absorbers and regulators for the color tone of white background can be added. These compounds are described in RD Nos. 17029 and 29963 and Japanese Patent O.P.I. Nos. 62-135825/1987 and 64- 13546/1989.

These additives can be added to arbitrary layers such as a light sensitive layer, an intermediate layer, a subbing layer, a protective layer and a backing layer.

When a light sensitive material is composed of two or more light sensitive layers, it is preferred that an intermediate layer is used between these two layers for preventing color stain. The intermediate layer is ordinarily composed of a hydrophilic binder such as gelatin. To the intermediate layer, in order to prevent color stain effectively, reducing agents such as an anti-diffusible hydroquinone for preventing the shift of an oxidation substance of the reducing agent to other layers and silver ion scavengers for preventing the diffusion of silver ions can be added.

As a support usable for the light sensitive material, transparent or intransparent synthetic plastic films such as a polyethylene terephthalate film and a polyethylene naphthalate film, various coated papers such as an art paper, a cast-coated paper and a baryta paper, papers laminated with a polyethylene resin and supports wherein an electron beam hardenable resin composition is coated and hardened are cited.

The light sensitive material used in the image forming method of the present invention preferably contains (a) a light sensitive silver halide emulsion, (b) a reducing agent, (c) a binder. The color light sensitive material further contains (d) a dye providing material. These may be added to a single photographic layer or to two or more layers separately. For example, components (a) and (b) are added to the same layer while (d) is added to a layer adjoining thereto. Otherwise, components (a) and (d) are added to the same layer while (b) is added to the other layer.

One spectral sensitive unit may consist of two or more light sensitive layers having substantially the same spectral sensitivity but different speed.

When the heat processable light sensitive material of the present invention is a full color recording material, it ordinarily has three light sensitive layers having a spectral sensitivity different from each other, wherein dyes having different hue are formed or released due to heat development. In such cases, generally, a blue sensitive layer (B) is combined with a yellow dye (Y), a green sensitive layer (G) is combined with a magenta dye (M) and a red sensitive layer (R) is combined with a cyan dye (C). However, in the present invention any combination is allowable. For example, combinations of (B-C)/(G-M)/(R-Y) and (an infrared sensitive layer-C)/(G-Y)/(R-M) can be used. In the present invention is also used a heat processable light sensitive material which has two different spectral sensitivity in an infrared region layer and has the third spectral sensitivity in a red region layer as described in Japanese Patent O.P.I. Publication No. 4-329541/1992.

In addition, the present invention can be applied to a method to form a black image by the use of a diffusible dye as described in Japanese Patent O.P.I. Publication No. 60-162251/1985.

To the light sensitive material of the present invention, light insensitive layers such as a subbing layer, an intermediate layer, a protective layer, a filter layer, a backing layer and a peeling layer can be arbitrarily provided in addition to the light sensitive layer.

When the image forming method of the present invention is a dye transfer method, an image receiving material having a dye image receiving layer is preferably used. The image receiving material may be composed of a support and the image receiving layer having a dye receiving ability provided thereon, or the support itself may serve as the image receiving layer having the dye receiving ability. The type of an image receiving layer is generally separated into two types; one is a type wherein a binder constituting the image receiving layer has dye receiving ability, and the other is a type wherein a mordant which can receive a dye is added to the binder.

In the image forming method of the invention an image receiving layer having a mordant in a hydrophilic binder is preferably used. As a mordant, polymers containing a tertiary amine salt or a quarternary ammonium salt are preferably used, including polymer mordants having a tertiary ammonium group described in Japanese Patent O.P.I. Publication Nos. 48- 75237/1973, 50-61228/1975, 50-80132/1975, 50-73440/1975, 53- 129034/1978, 54-145529/1979, 55-142339/1980, 56-161410/1981, 59-219745/1984, 62-30249/1987 and 62-34159/1987, polyvinyl pyridine mordants described in U.S. Pat. No. 3,249,393 and Japanese Patent O.P.I. Publication No. 60-23851/1985, polyvinyl imidazole mordants described in U.S. Pat. No. 4,115,124, British Patent Nos. 2056101 and 2093041, Japanese Patent O.P.I. Publication Nos. 69-55436/1984, 60-23854/1985, 60-39644/1985, 60-60643/1985, 60-118834/1985, 60-122941/1985 and 60-235124/1985, mordants described in Japanese Patent O.P.I. Publication No. 47-3689/1972 wherein a group having dying ability is graftized, combination of the use of a tertiary amine mordant and a quarternary ammonium mordant described in Japanese Patent O.P.I. Publication No. 60- 57836/1985 and mordants having an image stabilizing group described in Japanese Patent Publication O.P.I. Publication Nos. 63-198051/1988 and 2-32335/1990. As a binder used for carrying the above-mentioned mordants, for example, a hydrophilic binder such as gelatin, polyvinyl alcohol or dextran is preferably used.

The image receiving material may be provided with one image receiving layer or plural layers on a support. In the plural layers, all of them may be dye image receiving layers, or some of them may be image receiving layers.

When the image receiving material has a support and an image receiving layer, the support in the image receiving material may either be a transparent support or a reflection support. For example, a support composed of polyethylene terephthalate or polypropyrene and a support wherein white pigment such as barium sulfate and titanium dioxide are added to polyethylene terephthalate or polypropylene, an art paper, a cast-coated paper, a baryta paper, a laminated paper laminated with a thermoplastic resin (polyethylene) containing white pigment, clothes, glasses, a metallic foil such as aluminum, a support wherein an electron beam hardenable resin composition containing a pigment on the support is coated and hardened and a reflection support having a second-category diffusion reflectivity can be used.

When a paper support is used as a support for the light sensitive material and/or the image receiving material of the present invention, a support laminated with polyethylene on both sides of the paper support, is preferable. In such a case, it is preferable that titanium oxide is added in at least one side of the laminated polyethylene.

It is preferable that the surface of the paper support laminated with the above-mentioned polyethylene has excellent smoothness. The Beck smoothness degree, which is stipulated in JIS-P-8119, of the surface wherein the dye image receiving layer or the light sensitive layer is coated is preferably 50 seconds or more and more preferably 100 seconds or more. With regard to a filter wave waving curve induced from a cross-sectional curve wherein the surface of aforesaid support was measured in accordance with the standard of JIS-B-0610 under the cut-off value of 0.8 mm, when the maximum filter wave waving value with 2.5 mm as the standard length is measured, it is preferable that the number of points wherein the maximum waving of 4 μm or more is not more than 4 at arbitrary 100 measurement points. In addition, the average roughness of the central line in such cases is preferably 3 μm or less.

In addition, it is preferable that the base paper for the above-mentioned polyethylene-laminated paper has constitution and characteristics as described in Japanese Patent O.P.I. Publication No. 4-321043/1992, from 32nd line in the 6th column on page 4 to the 28th line on 8th column on page 5.

The heat processable light sensitive material of the present invention may be so-called mono-sheet type heat processable light sensitive material as described in RD No. 15108, Japanese Patent O.P.I. Publication Nos. 57-198458/1982, 57-207250/1982 and 61-80148/1986 wherein the light sensitive layer and the image-receiving layer are laminated on the same support in advance.

Various additives can be added to the image receiving material of the present invention. Examples of such additives include contamination preventing agents, UV absorbers (benzophenone or benzotriazole compounds described in Japanese Patent O.P.I. Publication Nos. 60-130735/1985 and 61- 153638/1986), fluorescent brightening agents (diaminostylbene compounds described in Japanese Patent O.P.I. Publication No. 61-143752/1986 or compounds described in Japanese Patent O.P.I. Publication No. 63-147166/1988), image stabilizers (those described in Japanese Patent O.P.I. Publication Nos. 59-182785/1984 and 61-159644/1986), development accelerators, anti-foggants (KBr, NaCl, KI, benzotriazole derivatives and nitrogen-containing heterocyclic compounds such as 1-phenyl-5-mercapto triazole derivatives), pH regulators, heat solvents, organic fluorine-containing compounds, oil drops, surfactants, hardeners, polymer latex (described in Japanese Patent O.P.I. Publication No. 61-156045/1986), matting agents and various metal ions.

The light sensitive material and the image receiving material of the present invention may be provided with the so-called backing layer in order to take color balance and improve smoothness. As the backing layer, a hydrophilic binder and a hydrophobic binder can be used. They can be selected appropriately depending upon application or constitution. The heat processable light sensitive material in the image forming method of the present invention is exposed to light by means of an exposure means suitable for the spectral sensitivity of the light sensitive material.

As a usable light source for exposure, a tungsten lamp, a halogen lamp, a xenon lamp, a mercury lamp, a CRT light-source, a FO-CRT light-source, a light-emitting diode, a laser light source, (for example, a gas laser, a dye laser, a YAG laser and a semi-conductor laser) can be used singly or in combination. In addition, a light-source combining a semiconductor laser and a SHG element (the second harmonics generating element) can be used.

Exposure time varies depending upon whether one image plane is subjected to a single exposure or each pixel on the image plane is digitally exposed. In the case of the former, the exposure time is ordinarily 0.001 second to 10 seconds. In the case of the latter, it is conducted from $10^{-8}$ to $10^{-2}$ second. In the case of digital exposure, each pixel may be subjected to either a single exposure or multiple exposures. In the case of multiple exposure, each image region may be slid little by little for every exposure.

In the image forming method of the invention the light sensitive material is, after or during imagewise exposure, heat developed at preferably 60° to 200° C. and more preferably at 70° to 170° C. and for preferably 1 to 100 seconds and more preferably 2 to 60 seconds for development so that dye images are formed. The transfer of diffusible dyes to an image receiving material may be conducted during heat development by bringing an image receiving layer surface of the image-receiving material into contact with a light sensitive layer side of the light sensitive material. Besides the above method, the image receiving material may be brought into contact with the light sensitive material after heat development, and heated to transfer the dyes. The former method is preferable in view of shortage of the processing time.

It is preferable that a small amount of water may be supplied to the light sensitive material or the image-receiving material before heat development, and then both are adhered to each other, followed by heat development. In such a case, water may be pure water, an aqueous alkali solution, or water containing a surfactant, the above-mentioned heat solvent or a compound represented by Formula I. It is preferred that the amount of water supplied is within the range of the maximum-swelled layer thickness of the light sensitive material or the image receiving material supplied. Further, the water may contain anti-funji, development accelerator, an anti-foggant or a fluorescent brightening agent.

The heat development includes the conventional heating method, for example, a method to bring a heat development material into contact with a heated heat block, a plane heater, a heat roller or a heat drum, a method to let the light sensitive material pass through ambience kept at high temperature, a method to use high frequency heating system and a method to electrify to a heat conductive layer such as a carbon black layer which is provided on the rear surface of the light sensitive material or an image-receiving material.

There is no limitation to a heating method in heat development. An arbitrary method such as a method to heat at a constant temperature, a method to heat at a high temperature in the initial stage of development and then to heat at a low temperature in the second half of development, a reversed method in which the low temperature development precedes the high temperature development, a method to change temperature at three steps or more or a method to continuously change temperature can be used. Especially, as described in Japanese Patent O.P.I. Publication No. 63-250646/1988, it is allowed, in a dye releasing system, to heat at low temperature in advance for the development of silver to some extent so that the development of silver occurs priorily prior to the reaction of the release of dye.

EXAMPLES

The present invention will be detailed in Examples below, but is not limited thereto.

Example 1

<Preparation of Heat Processable Light Sensitive Material>

The following layers were coated in order on a titanium oxide-containing polyethylene layer side of a 100 μm thick paper support wherein both sides thereof are laminated with polyethylenes and the polyethylene on one side of the support contains titanium oxide in an amount of 10% by weight. Thus, the heat processable light sensitive material D101 was prepared. The added amount of each component is indicated in terms of the weight per $m^2$ of the heat processable light sensitive material and the amount of the light-sensitive silver halide emulsion is indicated by converting it to the silver amount.

1st layer (Blue sensitive layer)

Gelatin 2.0 g

Blue sensitive silver halide emulsion (Em-1) 0.22 g

Dye providing material (MN-1) 2.06 g

Surfactant (SU-1) 0.14 g

High boiling organic solvent (HBS-1) 2.0 g

2nd layer (Protective layer)

Gelatin 1.0 g

Zinc hydroxide (the average grain size: about 0.2 μm) 1.0 g

1-Phenyl-4,4-dimethyl-3-pyrazolidone 0.04 g

Surfactant (SU-1) 0.07 g

Surfactant (SU-2) 0. 004 g

Hardener (HA-1:added immediately before coating) 0.08 g

A cubic crystal silver iodobromide emulsion comprising silver halide grains having an average grain size of about 0.4 μm (wherein the content of AgI was about 2 mol %) was subjected to chemical sensitization to the optimum sensitivity with sodium thiosulfate in the presence of 0.5 millimol per mol of silver halide of sensitizing dye SDB-1 and 0.12 g per mol of silver halide of stabilizing agent ST-1. After the chemical sensitization, 1 g per mol of silver halide of stabilizing agent ST-1 was firther added. Thus, blue sensitive silver halide emulsion (Em-1) was prepared.

The dye providing material (MN-1) was added in the form of a dispersion in which the dye providing material was dispersed with high boiling organic solvent (HBS-1) in a gelatin.

The resulting heat developable light-sensitive material D101 was stored for 2 days at 35° C. and at 50 to 60% RH so that the layers were hardened.

<Preparation of Dye Receiving Material>

The following layers were coated in order on a titanium oxide-containing polyethylene layer side of a 100 μm thick paper support wherein both sides thereof are laminated with polyethylenes and the polyethylene on one side of the support contains titanium oxide in an amount of 10% by weight. Thus, the following dye receiving materials R101 through R106 were prepared. The added amount of each component in each layer is indicated in terms of the weight per $m^2$ of the dye receiving material. The surface layer pH of the materials was adjusted by adjusting pH of a coating solution of the third layer with sodium hydroxide or surfuric acid. Comparative dye receiving materials R107 through R109 were prepared in the same manner as in above, except that AR-1 through AR-3 were used as complex forming compounds added in the first and second layers, respectively, and Comparative dye receiving material R110 was prepared in the same manner as in above, except that the complex forming compound was not added to the first and second layers.

1st layer

Gelatin 0.6 g

Surfactant (SU-1) 0.02 g

Complex forming compound shown in Table 5.0 mmol

2nd layer

Gelatin 1.8 g

Surfactant (SU-1) 0.02 g

Surfactant (SU-2) 0.01 g

Dye mordant 2.8 g

3rd layer

Gelatin 0.5 g

Complex forming compound shown in Table 5.0 mmol

Surfactant (SU-1) 0.02 g

Surfactant (SU-2) 0.02 g

Hardener (HA-1:added immediately before coating) 0.1 g

Silicone oil 0.02 g

Matting agent (silica having an average grain size of 6 μm) 0.01 g pH adjusting agent amount necessary to adjust pH The resulting dye receiving material was stored for 2 days at 35° C. and at 50 to 60% RH so that the layers were hardened. After the hardening, on the surface of the dye receiving layer was dropped 0.03 ml of pure water using a micro syringe and pH of the layer surface was measured using a plane pH electrode (GS-5013F produced by TOA DENPA KOGYO Co., Ltd.).

| Image Reciving Material | Complex Forming Compound | Surface pH | Remarks |
|---|---|---|---|
| R101 | A-1 | 10.1 | Invention |
| R102 | A-4 | 9.5 | Invention |
| R103 | A-7 | 9.4 | Invention |
| R104 | A-12 | 10.2 | Invention |

-continued

| Image Reciving Material | Complex Forming Compound | Surface pH | Remarks |
|---|---|---|---|
| R105 | A-7 | 8.2 | Invention |
| R106 | A-12 | 8.1 | Invention |
| R107 | AR-1 | 10.3 | Comparative |
| R108 | AR-2 | 10.2 | Comparative |
| R109 | AR-3 | 8.0 | Comparative |
| R110 | None | 8.0 | Comparative |

The chemical structure of additives used herein will be shown below.

SU-1: Sodium tri-i-propyl naphthalene sulfonate
SU-2: Sodium sulfo di(2-ethylhexyl)succinate
HBS-1: Di(2-ethylhexyl)phthalate
ST-1: 4-hydroxy-6-methyl-1,3,3a,7-tetrazaindene
HA-1: Reaction mixture of $C(CH_2SO_2CH{=}CH_2)_4$ and $NH_2CH_2CH_2SO_3K$ (1:0.75, mole ratio)
AR-1: $HN(CH_2COONa)_2$
AR-2: $CH_3CH_2CH_2N(CH_2COONa)_2$

AR-3

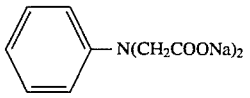

MN-1

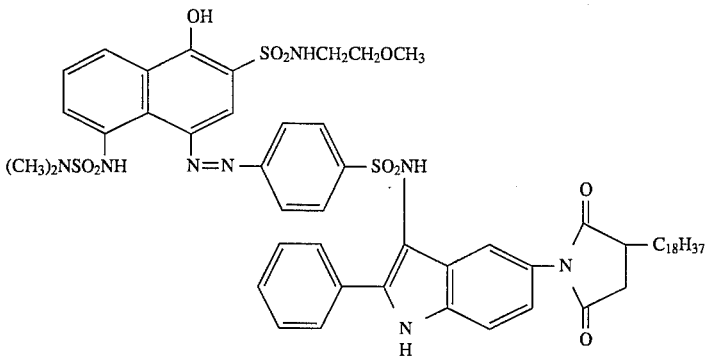

SDB-1

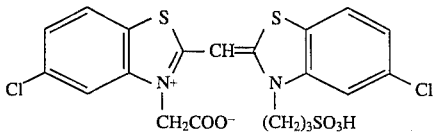

Dye mordant

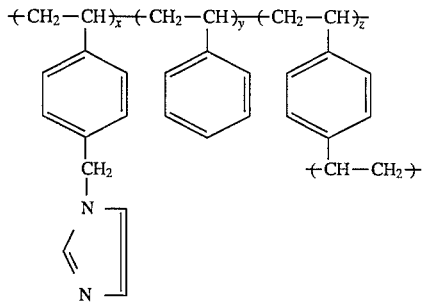

x:y:z = 70:26:4 (mole % ratio)

<Evaluation of the Heat Processable Light Sensitive Material>

After the heat processable light sensitive material D101 was exposed to white light through step wedge, it was immersed in 30° C. pure water for 5 seconds. Then, the resulting light sensitive material was superposed on the image receiving layer of the image receiving material, so that the light sensitive layer of the light sensitive material directly contacted the image receiving layer, and heated at 80° C. for 15 seconds. Next, the image receiving material was peeled from the light sensitive material. The reflexion density of the transfer image obtained on the image receiving layer was measured using PDA-65 produced by Konica Corporation. The unevenness of the image was also observed for evaluation. The gloss of the image plane was measured according to JIS-Z8471 using Desital gloss meter GM-26D (produced by Murakami Sikisai Co., Ltd.) which is of the 60° incident light receiving type. The results are shown in the following Table 1. In Table 1, Dmin and Dmax represent the minimum reflexion density and maximum reflexion density of a green light, respectively.

TABLE 1

| Light Sensitive Material | Image Receiving Material | Dmin/Dmax | Unevenness of Transfer Image | Peelability | Gloss (%) | Remarks |
|---|---|---|---|---|---|---|
| D101 | R101 | 0.29/1.66 | None | ⊙ | 83 | Invention |
| D101 | R102 | 0.26/1.64 | None | ○ | 89 | Invention |
| D101 | R103 | 0.24/1.65 | None | ⊙ | 91 | Invention |
| D101 | R104 | 0.24/1.66 | None | ⊙ | 93 | Invention |
| D101 | R105 | 0.23/1.55 | None | ⊙ | 90 | Invention |
| D101 | R106 | 0.24/1.58 | None | ⊙ | 92 | Invention |
| D101 | R107 | 0.29/1.58 | None | Δ | 76 | Comparative |
| D101 | R108 | 0.25/1.53 | None | X | 78 | Comparative |
| D101 | R109 | 0.38/1.67 | None | Δ | 75 | Comparative |
| D101 | R110 | 0.02/0.04 | — | ○ | 79 | Comparative |

Evaluation Criteria of peelability
⊙: Peeling was carried out easily.
○: Peeling was carried out with slight difficulty but no image defects.
Δ: Peeling was carried out with great difficulty.
X: Peeling was carried out with separation of a part of the image receiving layer accompanied by image defects.

Further, the image receiving material was stored for 2 days at 40° C. and 80% RH. The resulting material were processed in the same manner as in above. The results are shown in Table 2.

TABLE 2

| Light Sensitive Material | Image Receiving Material | Dmin/Dmax | Unevenness of Transfer Image | Peelability | Gloss (%) | Remarks |
|---|---|---|---|---|---|---|
| D101 | R101 | 0.32/1.67 | None | ⊙ | 84 | Invention |
| D101 | R102 | 0.28/1.64 | None | ○ | 89 | Invention |
| D101 | R103 | 0.28/1.66 | None | ⊙ | 89 | Invention |
| D101 | R104 | 0.26/1.67 | None | ⊙ | 91 | Invention |
| D101 | R105 | 0.25/1.56 | None | ⊙ | 87 | invention |
| D101 | R106 | 0.26/1.62 | None | ⊙ | 90 | Invention |
| D101 | R107 | 0.32/1.61 | None | X | 72 | Comparative |
| D101 | R108 | 0.31/1.60 | None | X | 73 | Comparative |
| D101 | R109 | 0.40/1.67 | None | X | 74 | Comparative |
| D101 | R110 | 0.03/0.06 | — | Δ | 80 | Comparative |

As is apparent from the above Tables, the method of the invention shows a high contrast image without image defects and excellent peelability and gloss, and further, the image receiving material used in the invention does not cause deterioration of image quality after storage.

Example 2

<Preparation of Heat Processable Light Sensitive Material>

The following layers were coated in order on a titanium oxide-containing polyethylene layer side of a 100 μm thick paper support wherein both sides thereof are laminated with polyethylenes and the polyethylene on one side of the support contains titanium oxide in an amount of 10% by weight. Thus, the heat processable-light sensitive material D201 was prepared.

1st layer (Blue sensitive layer)

Gelatin 2.0 g

Blue sensitive silver halide emulsion (Em-1) 0.22 g(Ag)

Dye providing material (YP-1) 1.66 g

YP-1

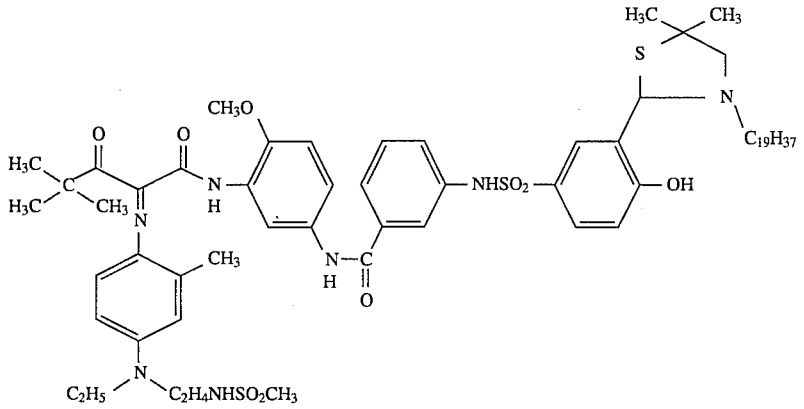

Surfactant (SU-1) 0.14 g

High boiling organic solvent (HBS-1) 2.0 g

2nd layer (Protective layer)

Gelatin 1.0 g

Zinc hydroxide (the average grain size: about 0.2 μm) 1.0 g

1-Phenyl-4,4-dimethyl-3-pyrazolidone 1.10 g

Surfactant (SU-1) 0.07 g

Surfactant (SU-2) 0.004 g

Hardener (HA-1:added immediately before coating) 0.08 g

The dye providing material (YP-1) was added in the form of a dispersion in which the dye providing material was dispersed with high boiling organic solvent (HBS-1) in a gelatin solution.

The resulting heat developable light-sensitive material D201 was stored for 2 days at 35° C. and at 50 to 60% RH so that the layers were hardened.

Heat developable light sensitive materials D202 was prepared in the same manner as in D201, except that the adding amount of zinc hydroxide was 2.0 g.

<Preparation of Dye Receiving Material>

The following layers were coated in order on a titanium oxide-containing polyethylene layer side of a 100 μm thick paper support wherein both sides thereof are laminated with polyethylenes and the polyethylene on one side of the support contains titanium oxide in an amount of 10% by weight. Thus, the following dye receiving materials R201 through R302 were prepared. Sodium hydroxide or surfuric acid was used as a pH adjusting agent.

1st layer

Gelatin 0.6 g

Surfactant (SU-1) 0.02 g

Complex forming compound shown below 5.0 mmol

2nd layer

Gelatin 1.8 g

Surfactant (SU-1) 0.02 g

Surfactant (SU-2) 0.01 g

Dye mordant 2.8 g

3rd layer

Gelatin 0.5 g

Complex forming compound shown in Table 5.0 mmol

Surfactant (SU-1) 0.02 g

Surfactant (SU-2) 0.02 g

Hardener (HA-1:added immediately before coating) 0.1 g

Silicone oil 0.02 g

Matting agent (silica having an average grain size of 6 μm) 0.01 g pH adjusting agent amount necessary to adjust pH The resulting dye receiving material was stored for 2 days at 35° C. and at 50 to 60% RH so that the layers were hardened.

| Image Reciving Material | Complex Forming Compound | Surface pH | Remarks |
|---|---|---|---|
| R201 | A-5 | 9.5 | Invention |
| R202 | A-13 | 10.1 | Invention |
| R301 | A-6 | 9.4 | Invention |
| R302 | A-14 | 10.2 | Invention |

<Evaluation of the Image Formed>

After the heat processable light sensitive materials D201 and D202 were exposed to white light through step wedge, they were immersed in 30° C. pure water for 5 seconds. Then, the light sensitive material was superposed on the image receiving layer of the image receiving material so that the light sensitive layer of the light sensitive material directly contacted the image receiving layer and heated at 80° C. for 15 seconds. Next, the image receiving material was peeled from the light sensitive material. The transfer image obtained on the image receiving layer was evaluated in the same manner as in Example 1. The results are shown in Table 3.

TABLE 3

| Light Sensitive Material | Image Receiving Material | Dmin/Dmax | Unevenness of Transfer Image | Peelability | Gloss (%) | Remarks |
|---|---|---|---|---|---|---|
| D201 | R201 | 0.25/1.64 | None | ○ | 88 | Invention |
| D201 | R202 | 0.24/1.64 | None | ◎ | 92 | Invention |
| D201 | R301 | 0.29/1.65 | None | ○ | 90 | Invention |
| D201 | R302 | 0.26/1.66 | None | ◎ | 93 | Invention |
| R202 | R301 | 0.26/1.69 | None | ○ | 91 | Invention |
| R202 | R302 | 0.25/1.70 | None | ◎ | 92 | Invention |

As is apparent from the above Table, the method of the invention shows a high contrast image without image defects and excellent peelability and gloss.

What is claimed is:

1. An image forming method comprising the steps of:

(a) exposing a silver halide photographic light-sensitive material comprising a first support and provided thereon, a photographic component layer comprising a first binder, light sensitive silver halide and a metal compound selected from the group consisting of $Zn(OH)_2$, ZnO, $Co(OH)_2$, CoO, $Ni(OH)_2$, $Cu(OH)_2$, $Fe(OH)_2$, $Mn(OH)_2$, $BaCO_3$, $SrCO_3$, $CaCO_3$, basic lead carbonate, basic cobalt carbonate, basic nickel carbonate and basic bismuth carbonate;

(b) superposing the exposed material on an image receiving material comprising a second support and provided thereon, an image receiving layer comprising a second binder and a compound represented by Formula (I),

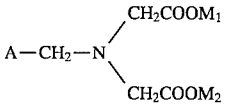

Formula (I)

wherein A represents a cycloalkyl group, an aryl group or a heterocyclic ring; and $M_1$ and $M_2$ independently represent an alkali metal atom, an ammonium ion or a quaternary ammonium ion, so that the photographic component layer of the exposed material contacts the image receiving layer;

(c) heating the superposed materials in the presence of water; and (d) separating the image receiving material from the exposed material to obtain an image on the image receiving layer of the image receiving material.

2. The image forming method of claim 1, wherein, in Formula (I), A is selected from the group consisting of pyridyl, pyradinyl, pyrimidinyl, pyridadinyl, pyrrolyl, pyrazolyl, imidazolyl, tetrazolyl, furyl and phenyl.

3. The image forming method of claim 1, wherein the silver halide photographic light-sensitive material further comprises a non-diffusible dye providing material capable of forming or releasing a diffusible dye, and the image receiving material further comprises a dye mordant.

4. The image forming method of claim 1, wherein said heating is carried out at 60° C. or more.

5. The image forming method of claim 1, wherein the pH of the surface of the image receiving layer is 8.5 to 10.5.

6. The image forming method of claim 1, wherein the metal compound is contained in an amount of 1 to 200 millimoles per $m^2$ of the superposed materials.

7. The image forming method of claim 1, wherein the compound represented by Formula (I) is contained in an amount of 1 to 100 millimoles per $m^2$ of the superposed materials.

8. An image forming method comprising the steps of:

(a) exposing a silver halide photographic light-sensitive material comprising a first support and provided thereon, a photographic component layer comprising a first binder, light sensitive silver halide and a compound represented by Formula (I),

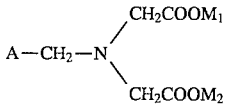

Formula (I)

wherein A represents a cycloalkyl group, an aryl group or a heterocyclic ring; and $M_1$ and $M_2$ independently represent an alkali metal atom, an ammonium ion or a quaternary ammonium ion;

(b) superposing the exposed material on an image receiving material comprising a second support and provided thereon, an image receiving layer comprising a second binder and a metal compound selected from the group consisting of $Zn(OH)_2$, ZnO, $Co(OH)_2$, CoO, $Ni(OH)_2$, $Cu(OH)_2$, $Fe(OH)_2$, $Mn(OH)_2$, $BaCO_3$, $SrCO_3$, $CaCO_3$, basic lead carbonate, basic cobalt carbonate, basic nickel carbonate and basic bismuth carbonate, so that the photographic component layer of the exposed material contacts the image receiving layer;

(c) heating the superposed materials in the presence of water; and (d) separating the image receiving material from the exposed material to obtain an image on the image receiving layer of the image receiving material.

* * * * *